US008037842B2

(12) United States Patent
Kuwata

(10) Patent No.: US 8,037,842 B2
(45) Date of Patent: Oct. 18, 2011

(54) METHOD AND APPARATUS FOR EJECTING INK DROPLETS ONTO A SUBSTRATE

(75) Inventor: Hisashi Kuwata, Kanagawa (JP)

(73) Assignee: NEC LCD Technologies, Ltd, Kanagawa (JP)

( * ) Notice: Subject to any disclaimer, the term of this patent is extended or adjusted under 35 U.S.C. 154(b) by 675 days.

(21) Appl. No.: 12/058,799

(22) Filed: Mar. 31, 2008

(65) Prior Publication Data

US 2008/0238968 A1 Oct. 2, 2008

(30) Foreign Application Priority Data

Mar. 30, 2007 (JP) ..... 2007-090362

(51) Int. Cl.
*B05B 7/06* (2006.01)

(52) U.S. Cl. ..... 118/313; 118/314; 118/315; 427/240; 156/345.11; 156/345.24

(58) Field of Classification Search ..... 118/313–315; 427/240; 156/345.11, 345.24
See application file for complete search history.

(56) References Cited

U.S. PATENT DOCUMENTS

2005/0253995 A1 11/2005 Inoue et al.
2006/0051498 A1* 3/2006 Katagami et al. ..... 427/66
2006/0292293 A1* 12/2006 Tsuruoka et al. ..... 427/96.8

FOREIGN PATENT DOCUMENTS

JP 11-024083 1/1999
JP 2003-215612 7/2003

* cited by examiner

*Primary Examiner* — Dah-Wei D Yuan
*Assistant Examiner* — Albert Hilton
(74) *Attorney, Agent, or Firm* — Young & Thompson

(57) ABSTRACT

An ink mixed with spacer members is ejected onto one or both of a TFT substrate and a CF substrate while an ink jet head having a plurality of ink jet nozzles is moved. The excursions of a predetermined number of ink jet nozzles from an end of the ink jet head overlap those of a next excursion of the ink jet head without causing overlapping of ejected ink within the overlapping area. An abrupt stepwise change in the amount of ejected ink is suppressed whereby an uneven gap is suppressed.

4 Claims, 8 Drawing Sheets

METHOD AND APPARATUS FOR EJECTING INK DROPLETS ONTO A SUBSTRATE

This application is based upon and claims the benefit of priority from Japanese patent application No. 2007-090362 filed on Mar. 30, 2007, the disclosure of which is incorporated herein in its entirety by reference.

BACKGROUND OF THE INVENTION

1. Field of the Invention

The present invention relates to a method and apparatus for ejecting ink droplets onto a substrate and, more particularly, to a method and apparatus suitably used in a process for manufacturing a LCD device including ejecting an ink mixed with spacer members onto a substrate of an LC panel to form spacers.

2. Description of the Related Art

LCD devices have a variety of advantages including slim body, light weight and low power dissipation, and are therefore widely used as a display unit for an audio-video equipment and an office automation equipment. The LCD devices usually includes a liquid crystal (LC) panel in which a LC layer is sandwiched between a substrate (hereinafter referred to as a TFT substrate) and another substrate (hereinafter referred to as a CF substrate), in the TFT substrate, switching elements such as TFTs (thin film transistors) are arranged in a matrix. In the CF substrate, color filter (CFs) and a black matrix BM) layer are formed. Orientations of LC molecules in the LC layer are controlled by an electric field generated between two electrodes, which are provided on one of the substrates or respective substrates, to thereby change the light transmittance of the LC layer.

In order to improve the image quality of the LC panel as described above, control of a gap (cell gap) between the TFT substrate and the CF substrate is important. Usually, spacers (such as spherical spacers or columnar spacers) having a predetermined shape and dimensions is provided between the substrates. For example, a LCD device is known in which columnar spacers are provided at fixed points, for the purpose of achieving a higher performance such as higher response speed, higher definition, and higher contrast ratio (refer to Patent Publication JP-2003-215612-A1, for example).

The columnar spacers described above are less elastic compared to typical spherical spacers. The columnar spacers therefore have the drawback that a change in the volume of LC molecules caused by a temperature fluctuation incurs a larger range of unevenness of the image due to an uneven gap or due to a larger strain caused by a thermal stress in the LC panel. Since there has been a tendency to achieve a narrower gap for the LC layer recent years, the above drawback causes a more critical problem. In addition, the columnar spacers are formed by use of a photolithographic technique, and thus complicate the manufacturing process and raise the fabrication costs.

In view of the above drawbacks in a LCD device including the columnar spacers, there has been employed a technique using spherical spacers in the LCD device, wherein the spherical spacers are mixed with an ink ejected from an ink jet nozzle. For example, Patent Publication JP-1999-24083-A1 describes a configuration in which a number of spacer members are ejected in a single ink droplet from an ink jet head. In the described configuration, a plurality of spherical spacer members are aggregated to form a spacer, and the thus formed spacer is disposed to overlap a stripe portion of the black matrix, at which adjacent pixels are separated. The stripe portion may be at a cross section between two perpendicular stripes of the black matrix, or may be a T-shaped intersection between two perpendicular stripes.

It is desirable that the ink jet head be provided with a plurality of ink jet nozzles arranged one a line, or in a one-dimensional array, and the ink jet nozzles eject therefrom ink droplets simultaneously, so as to improve the throughput for the ink ejection. After a single ejection of the ink droplets from the plurality of ink jet nozzles, the array of the ink jet nozzles is moved in the direction perpendicular to the extending direction of the array to scan a single area of the LCD device. After completion of ejection of the single a by a scanning ejection, the array of ink ejection nozzles is moved in the direction parallel to the extending direction of the array of the ink jet nozzles, and an adjacent area is then scanned similarly to the first area, although the scanning direction is opposite to the direction for forming the previous single area.

In the above configuration of the ink jet nozzles however, it is likely that the ink droplets ejected by the plurality of ink jet nozzles do not have a uniform volume, and that the volume of the ink droplets varies monotonically from one end of the array of the ink jet nozzles to the other end of the array. This causes the volume of ink droplet significantly differs between an ink droplet ejected by an ink jet nozzle located at the one end of the array and another ink droplet ejected by another ink jet nozzle located at the other end of the array, although both the ink droplets are juxtaposed on the LC panel. The different volumes of the ink droplets cause different numbers of the spacer members included in each spacer, and causes different elasticity between adjacent stripes of the black matrix. This incurs an uneven gap length in the case of a volume expansion of the LC layer caused by a temperature rise.

SUMMARY OF THE INVENTION

The present invention has been made in view of the above problems and it is an object of the present invention to provide a method and an apparatus for ejecting a ink by using a plurality of ink jet nozzles, which are suited to manufacture of a LCD device and capable of suppressing deterioration of the image quality in the LCD device caused by an uneven gap length due to different numbers of the spacer members included in each ink droplet i.e., each spacer.

The present invention provides, in a first aspect thereof a method for ejecting an ink by using an ink jet head including a one-dimensional array of N ink jet nozzles, where N is an integer not smaller than 2, to form ink jet droplets on a substrate mounted on an X-Y table, the method including; moving the ink jet head and/or the X-Y table to cause a first excursion of the ink jet head with resect to the substrate along a first direction perpendicular to an extending direction of the array, the first excursion being accompanied by ink ejection from the ink jet nozzles to provide a first ejection area of the ink droplets on the substrate; and moving, alternately with the first excursion, the ink jet head and/or the X-Y table to cause a second excursion of the ink jet head with resect to the substrate along the first direction, the second excursion being accompanied by ink ejection from the ink jet nozzles to provide a second ejection area of the ink droplets on the substrate; moving the ink jet head and/or the X-Y table, between the first excursion and the second excursion, to cause a third excursion of the ink jet head with respect to the substrate in a direction parallel to the extending direction of the array, wherein: the first ejection area and the second ejection area having therebetween an overlapping excursion of at least two of the ink jet nozzles, and at least one of the at least two of the ink jet nozzles does not eject the ink during the first excursion and/or the second excursion, the at least one excluding an outermost one of the ink jet nozzles.

The present invention provides, in a second aspect thereof, an apparatus for ejecting an ink, including: an ink jet head mounting thereon N ink jet nozzles (where N is an integer not smaller than 2) arranged in an array; an X-Y table for mounting thereon a substrate; and a controller, wherein the controller controls the ink jet head and/or the X-Y table to: cause a first excursion of the ink jet head with resect to the substrate along a first direction perpendicular to an extending direction of the array, the first excursion being accompanied by ink ejection from the ink jet nozzles to provide a first ejection area of the ink droplets on the substrate; cause a second excursion of the ink jet head, alternately with the first excursion, with resect to the substrate along the first direction, the second excursion being accompanied by ink ejection from the ink jet nozzles to provide a second ejection area of the ink droplets on the substrate; cause a third excursion of the ink jet head, between the first excursion and the second excursion, with respect to the substrate in a direction parallel to the extending direction of the array, wherein: the first ejection area and the second ejection area having therebetween an overlapping excursion of at least two of the inkjet nozzles, and at least one of the at least two of the ink jet nozzles does not eject the ink during the first excursion and/or the second excursion, the at least one excluding an outermost one of the ink jet nozzles.

The above and other objects, features and advantages of the present invention will be more apparent from the following description, referring to the accompanying drawings.

DETAILED DESCRIPTION OF THE INVENTION

The principle of the present invention will be described hereinafter before describing exemplary embodiments of the present invention.

As has been described with reference to the related art, control of the gap length between the TFT substrate and the CF substrate in a LCD device is important to improve the image quality of the LCD device. The method of ejecting an ink mixed with spacer members using an ink jet printing technique is proposed in Patent Publication JP-1999-24083-A1, as described before. In this method, when a plurality of ink jet nozzles arranged in an array are operated to simultaneously eject ink droplets, there is a tendency that the volume of the ink droplet ejected by each ink jet nozzle monotonically varies along the direction of the array of the ink jet nozzles. In this case, the volume of the ink droplet corresponds to the number of spacer members included in the ink droplet. Therefore, the number of spacer members included in the ejected ink droplet abruptly changes at the boundary between adjacent ejection areas, each of which is subjected to a simultaneous ejection of ink droplets. As a result there is involved a problem in that an uneven gap is caused abruptly at the boundary between the adjacent ejection areas, thereby incurring degradation in the image quality of the LC panel.

In view of the above problem, an exemplary embodiment of the present invention employs a method that suppresses occurring of the uneven gap on the LC panel. In short the method of the embodiment includes controlling a movement of the ink jet head and/or the X-Y table mounting a substrate so that an excursion of some of the ink jet nozzles partially overlap between adjacent two of the ejection areas during the ejection of the ink mixed with spacer members onto one or both of the TFT substrate and the CF substrate mounted on the X-Y table. During the controlling of the movement the ink jet nozzles are controlled so that the in droplets are not ejected twice in the overlapping area between adjacent two areas. More specifically, in the overlapping area, the excursion of some ink jet nozzles in an ejection area is overlapped with the excursion of the other ink jet nozzles in the adjacent ejection area. However, the ejection of the ink twice on the overlapped excursion is prevented by stopping the ejection of either the some or the other ink jet nozzles excluding an outermost ink jet nozzle. In this manner, an abrupt change in the volume of ejected in (i.e., the number of spacer members in the ink droplet) at the interface between the ejection areas is avoided, whereby an uneven gap length is not conceived by an observer of the LCD device. The detail of the method of exemplary embodiments of the present invention will be described hereinafter with reference to the accompanying drawings.

Figure 1:
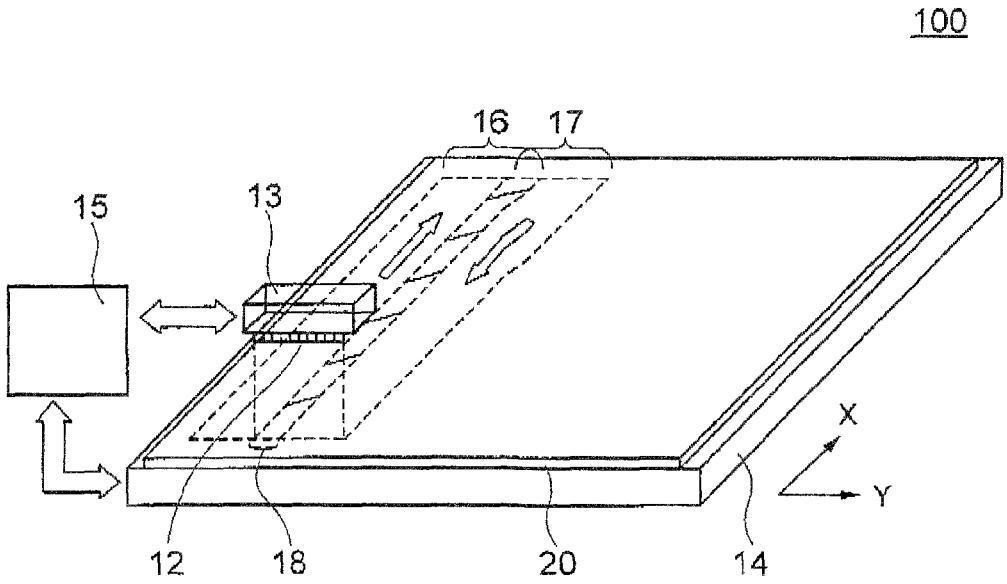
FIG. 1 is a perspective view schematically showing the configuration of an ink jet printing apparatus according to a first exemplary embodiment of the present invention and used in a system for manufacturing an LCD device.
Figure 2:
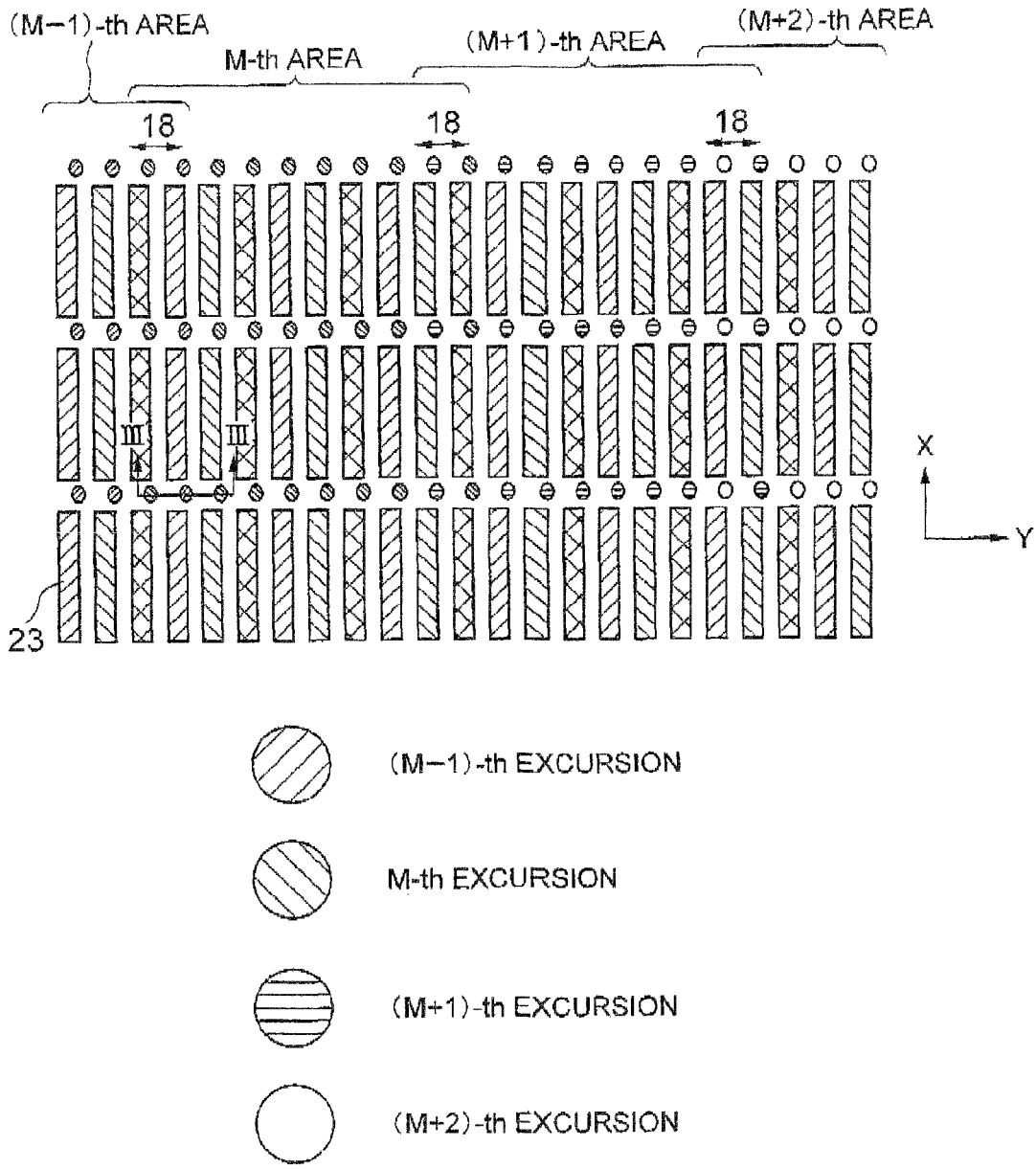
FIG. 2 is a top plan view showing an example of the layout of spacers on the CF substrate in the LCD device manufactured using the ink jet printing apparatus of the first embodiment.
Figure 3:
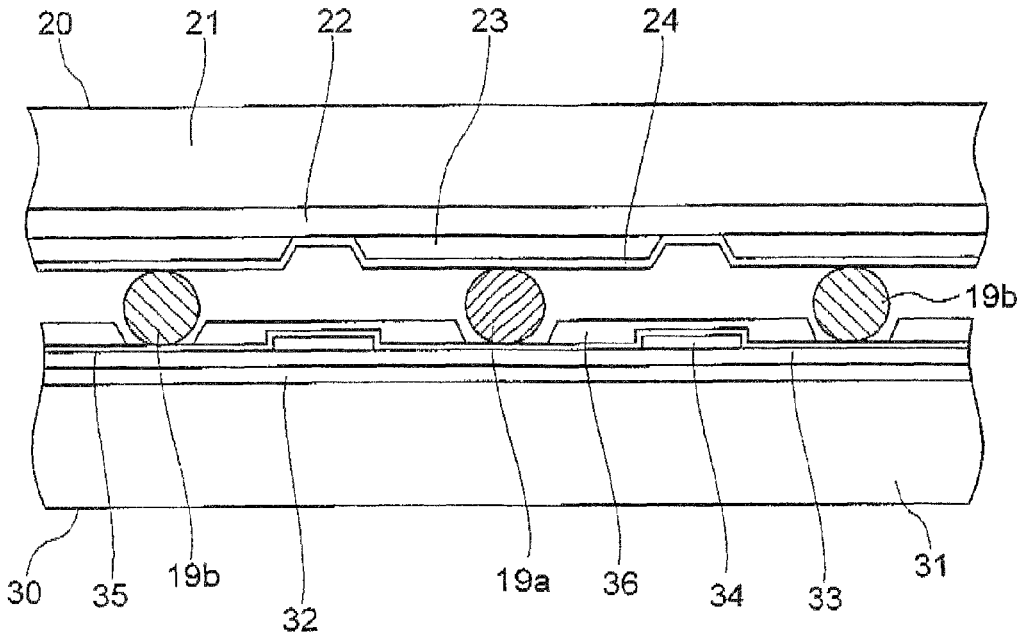
FIG. 3 is a sectional view showing the configuration of the LC panel in the LCD device manufactured using the ink jet printing device of the first embodiment.
Figure 4:
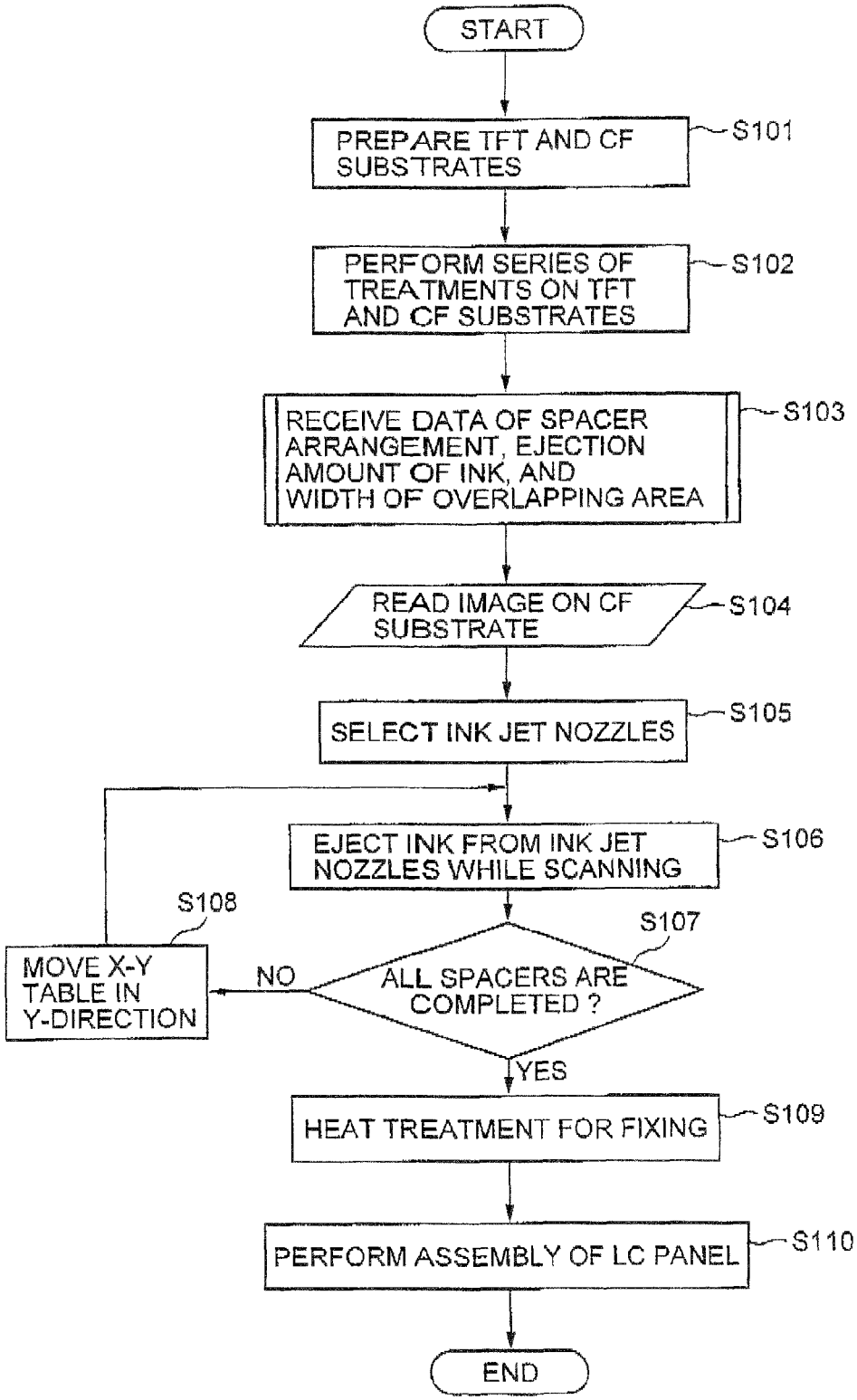
FIG. 4 is a flowchart showing the procedure of a method for manufacturing the LCD device by using a ink jet printing apparatus of the first embodiment.
Figure 5A:
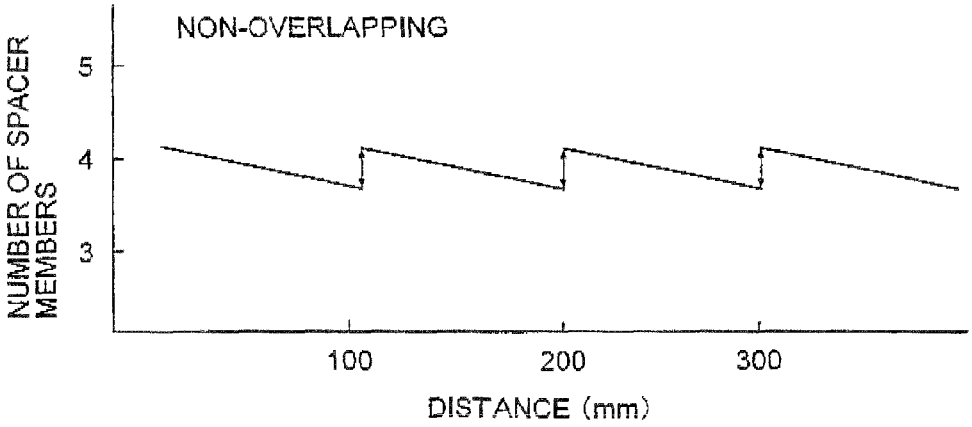
FIGS. 5A and 5B are a graph showing the relationship between the number of spacer members and the position in the LC panel in the case of overlapping ejection and non-overlapping ejection, respectively.
Figure 5B:
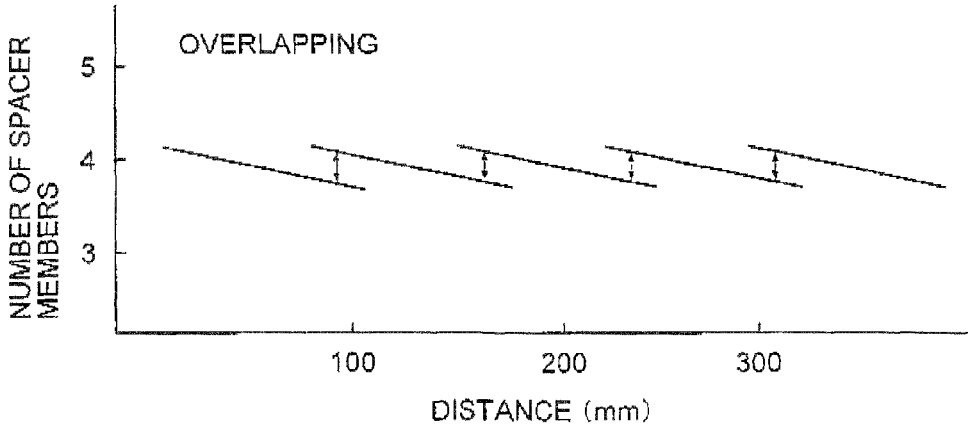
Figure 6:
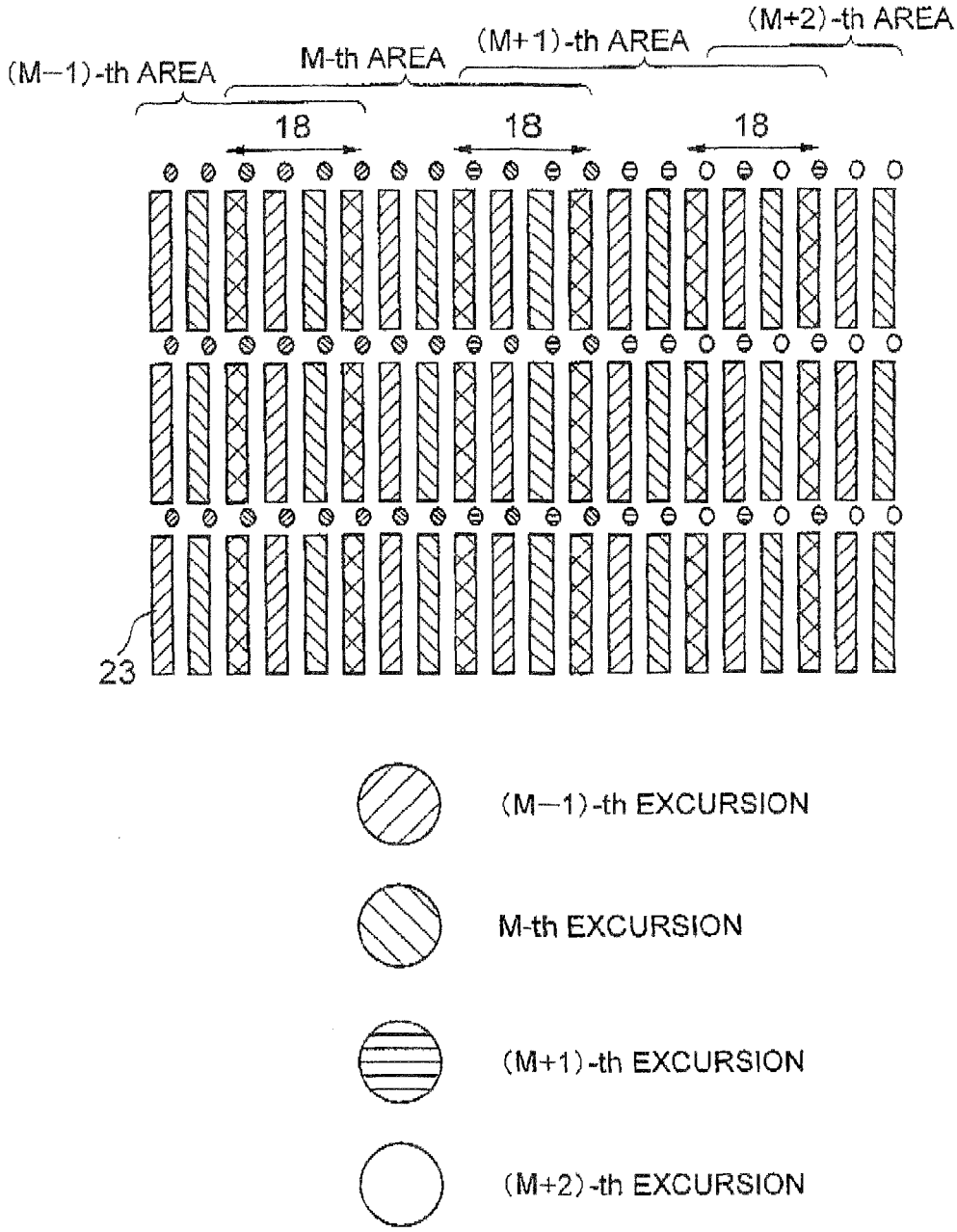
FIG. 6 is a top plan view showing another example of the layout of spacers on the CF substrate in the LCD device manufactured using the ink jet printing apparatus of the fit embodiment.
Figure 7:
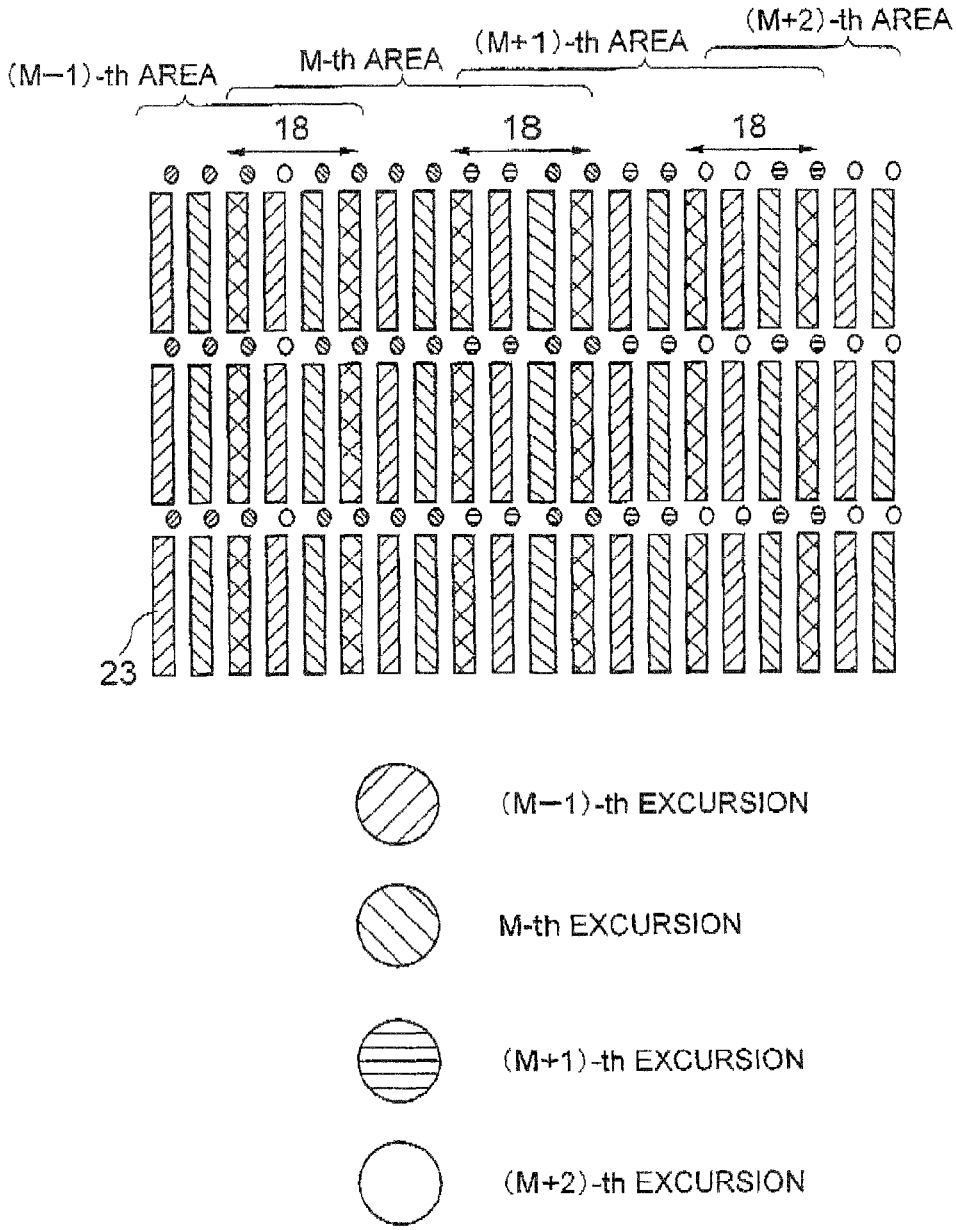
FIG. 7 is a top plan view showing another example of the layout of spacers on the CF substrate in the LCD device manufactured using the ink jet printing apparatus of the first embodiment.

A method and an apparatus for manufacturing a LCD device by using an ink jet printing apparatus according to a first exemplary embodiment of the present invention will be described below with reference to FIGS. 1 to 7. FIG. 1 is a perspective view schematically showing the configuration of the ink jet printing apparatus of the first embodiment FIG. 2 is a top plan view showing an example of the layout of spacers on the CF substrate manufactured using the method of the present embodiment. FIG. 3 is a sectional view showing the structure of the LC panel in the LCD device, taken along line III-III in FIG. 2. FIG. 4 is a flowchart showing a process for manufacturing the LCD device by using the method of the present embodiment FIGS. 5A and 5B are a graph for showing the advantage of the present embodiment. FIGS. 6 and 7 are a top plan view showing other examples of the layout of spacers in the CF substrate obtained using the method of the present embodiment.

A typical LCD device generally includes a LC panel, and a backlight unit disposed at the rear side of the LC panel. The LC panel to be obtained using the method of the present embodiment is configured by: an active matrix substrate (referred to as TFT substrate in this text) in which switching elements such as TFTs are arranged in a matrix; a counter substrate (e.g. CF substrate in the example of the present embodiment) which is disposed to oppose the TFT substrate; spacers each including a plurality of spacer members of a substantially spherical shape and provided between the TFT substrate and the CF substrate to determine a cell gap therebetween; and a LC layer sandwiched between the TFT substrate and the CF substrate within the cell gap defined by the spacers. The spacer members are provided, in the form a mixture with an ink, onto one or both of the TFT substrate and the CF substrate by using the ink jet printing apparatus. In the present embodiment the spacers are provided onto the CF substrate.

The ink jet printing apparatus 100 of the present embodiment used for ejecting the ink onto the CF substrate 20 is shown in FIG. 1. The inkjet printing apparatus 100 includes: a plurality of ink jet nozzles 12 which are arranged in a one dimensional array to eject an ink mixed with spacer members; an ink jet head 13 which mounts thereon the ink jet nozzles 12 and supplies the ink jet nozzles 12 with the ink; and an X-Y table 14 for mounting a substrate (CF substrate) 20 onto which the ink is to be ejected; a controller 15 which controls the movement and operation of the ink jet head 13 and X-Y table 14. The ink is ejected simultaneously as ink droplets arranged in a plurality of rows while moving the ink jet head 13 in the X-direction (hereinafter referred to as a first direction) perpendicular to the Y-direction hereinafter referred to as a second direction), which is parallel to the direction of the array in which the ink jet nozzles 12 are arranged. The X-Y table 14 is moved in the second direction after a single scanning operation of the ink jet head 13 is completed for ejecting the ink in an ejection area including the plurality of rows. These steps of moving the ink jet head in the first and second directions are repeated for a plurality of cycles until the entire area of the LC panel is subjected to the ink jet printing.

In the process of the present embodiment the ink jet head 13 moves in the fit direction and the X-Y table 14 moves in the second direction. However, the process may be such that only the X-Y table 14 is moved in both the first and second directions without moving the ink jet head 13. Alternatively, only the ink jet head 13 may be moved in both the first and second directions without moving the X-Y table 14, or both the ink jet head 13 and the X-Y table 14 may be moved. FIG. 1 shows the configuration in which the ink jet head 13 ejects the ink droplets during both the outward and homeward movements along the first direction. However, this movement may be modified so that the ink is ejected only during the outward movement along the first diction, and the ink is not ejected during the homeward movement and is ejected again during the outward movement.

Neither the density of spacer members mixed in the ink nor the volume of the ink droplet ejected by each ink jet nozzle 12 is particularly limited. The density of spacer members and the volume of ink droplet ejected by each ink jet nozzle 12 are adjusted in the present embodiment so that the ink droplet ejected by each inkjet nozzle 12 contains a single spacer member or a plurality of spacer members which form an aggregate of the spacer members acting as a spacer.

It is generally desirable that the plurality of ink jet nozzles 12 eject an equal volume of the ink for each ejection. In fact however, the volume of ink supplied to the ink jet nozzles 12 varies significantly, and the volumes of ink droplets ejected by the ink jet nozzles 12 are therefore not equal to one another, i.e., not constant. Normally, there is a tendency that the volume of ink droplet ejected by each ink jet nozzle 12 varies monotonically from an end of the array of the ink jet nozzles 12 in the ink jet head 13 to the other end of the array. If the excursions of the ink jet head 13 do not overlap each other for a plurality of movements of the ink jet head 13, the volume of ink droplet ejected by each ink jet nozzle 12 abruptly changes stepwise at the boundary between adjacent two ejection areas, each of which is obtained by a single excursion of the inkjet head 13 in the first direction normal to the direction in which the ink jet nozzles 12 are arranged.

The abrupt stepwise change in the volume of the ink droplet causes an abrupt change of the number of spacer members in the spacer, as shown in FIG. 5A. In the same figure, the location of the spacers along the second direction is plotted on abscissa as the distance from an edge of the CF substrate, whereas the number of spacer members received in the spacer is plotted on ordinate. The abrupt, stepwise change at the boundary between the ejection areas causes different number of spacer members in the ink droplet or spacer, which in turn causes an uneven gap length due to different degrees of elasticity, to thereby cause degradation in the image quality.

Hence, the ink jet printing apparatus 100 according to the present embodiment employs a technique such that the controller 15 controls the movement of the ink jet head 13 and/or the X-Y table 14 so that the excursion of some of the ink jet nozzles 12 in an outward movement overlap the excursion of the other some of the ink jet nozzles 12 in the subsequent homeward movement of the ink jet head 13. The controller 15 may be configured by a program running on a computer.

The above movement of the ink jet head 13 is shown in FIG. 1. The CF substrate 20 is set on the X-Y table 14 as a sample, and ink is ejected from a plurality of plural ink jet nozzles 12 onto predetermined positions of the CF substrate 20. During ejecting the ink onto the CF substrate 20, an overlapping area 18 is provided between adjacent two ejection areas, i.e., between a first ejection area 16 where the ink including spacer members is ejected onto the CF substrate while the ink jet head 13 is moved in the outward direction along the first direction and a second ejection area 17 where the ink including spacer members is ejected to the CF substrate while the ink jet head 13 is moved in the homeward direction along the first direction after the ejection in the first ejection area 16. This movement and supply of the ink are repeated in a similar manner until the entire surface area of the CF subset 20 is subjected to the ink ejection. As a result abrupt change of the gap between the excursions of the ink jet head 13 is reduced to thereby reduce the degree of the uneven gap length.

In the above operation, if the ink is ejected from the ink jet nozzles 12 in both the ejection areas 16, 17 during the outward and homeward movements of the ink jet head 13 the volume of ink droplets ejected by ink jet nozzles 13 win the overlapping area 18 is greater than that within a portion of the ejection areas other than the overlapping area. In view of this fact the controller 15 controls the operation of the ink jet head 13 so that some of the plural ink jet nozzles 12 stop ejection of the ink droplet therefrom.

FIG. 2 schematically shows the volume of ink droplets, i.e., the number of spacer members in the ink droplet ejected onto the surface of the CF substrate 20 due to the control by the controller. The surface of the CF substrate 20 is represented by the arrangement of the color layers, which correspond to the array of pixels formed on the TFT substrate. The CF substrate 20 includes a two-dimensional array of color layers of R, G, and B, which are differentiated from one another in the figure by different appearances of the hatching. That is, different appearances of the hatching correspond to different colors of the pixels, and represent the positions on the CF substrate. A plurality of dots disposed between adjacent two rows of the pixel areas represent the respective spacers. The ink is ejected onto the space between the color layers, i.e. on the area of stripes of the BM layer by which light is shielded.

Specifically, the overlapping area 18 between adjacent ejection areas 16, 17 shown in FIG. 2 includes two rows of the ink droplets in this example. In the example, the ink ejection from two ink jet nozzles 12, which are located second to the outermost ink jet nozzles of the array in the ink jet head 13 and thus referred to as second ink jet nozzles hereinafter, is stopped during each excursion of the ink jet head 13. In the operation during a (M−1)-th excursion of the ink jet head, the second ink jet nozzle 12 from the right end in the drawing does not eject the in whereas in the operation during a M-th excursion, the leftmost ink jet nozzle 12 in the drawing ejects the ink at the location wherein the second ink jet nozzle from the fight end did not eject the ink droplet during the (M−1)-th excursion. Similarly, in the operation during a (M)-th excursion of the ink jet head, the second ink jet nozzles 12 from the right and lefts end does not eject the ink whereas in the operation during a (M+1)-th excursion, the leftmost ink jet nozzle 12 in the drawing ejects the ink at the location where the second ink jet nozzle did not eject the ink droplet during the M-th excursion. This situation is shown in FIG. 5B, which shows the number of spacer members in each spacer, similarly to FIG. 5A.

In a generalized configuration, assuming that overlapping area includes two rows of the spacers and that the number of jet nozzles 12 in the array is N (where N is a positive integer) and order of the ink jet nozzles is counted from the left FIG. 1, the ink droplet is not ejected from the second and (−1)-th ink jet nozzles 12. In this configuration, excursions of the ink jet head 13 allow adjacent two ejection areas to overlap each other at two rows in the vicinity of the edge of each ejection area. FIG. 2 shows the result of the in ejection controlled in this manner for the case of N=10.

In the example shown in FIG. 2, the ink jet head 13 includes ten ink jet nozzles 12 in the array, and the overlapping 18 area includes two rows of the spaces. In this case where the overlapping area includes two rows of the spacers, the number of ink jet nozzles 12 in the array may be four or more. This is because, if N is 2, the ink is not ejected from any of the ink jet nozzles 12. Otherwise, if N is 3, only the central ink jet nozzle 12 does not eject the ink, and the ink is ejected twice at every row from the other ink jet nozzles 12.

In the example of FIG. 2, two of the ten rows of the spacers located in the vicinity of the edge of the ejection areas are overlapped between adjacent two ejection areas. However, any number of rows may be overlapped as far as the number of the overlapping rows is equal to or less than ½ of the number of the ink jet nozzles 12 in the array. For instance, if N is 8 or greater, the configuration can be arranged so that the ink is ejected from none of the second, fourth, (N−3)-th and (N−1)-th ink jet nozzles 12, as shown in FIG. 6. In this configuration, ejection areas of the ink jet head 13 overlap each other so that four rows of the spacers in the vicinity of the edge of an ejection area overlap four rows of the spacers of the adjacent ejection area. In an alternative, as shown in FIG. 7, the ink is ejected from none of third, fourth, (N−3)-th, and N−2)-th ink jet nozzles 12. In this configuration, ejection areas of the ink jet head 13 are overlapped each other so that four rows of the spacers in the vicinity of an edge of an ejection area overlap four rows of spacers of the adjacent ejection area.

Referring back to FIG. 2, although a single spacer is provided for each of the color layers 23, the pacers can be arranged so that one spacer is provided for a plurality of color layers 23. For instance, a single spacer may be provided for each adjacent three color layers 23, or a single spacer may be provided for each 2×2 color layers 23.

Now, a procedure for manufacturing a LCD device by using the ink jet printing apparatus 100 will be described with reference to the LC panel shown in FIG. 3 and with reference to the flowchart shown in FIG. 4.

To begin with, the CF substrate 20 and the TFT substrate 30 are prepared in a step S101 (FIG. 4) in accordance with a well known process.

The CF substrate 20 (FIG. 3) includes: a transparent insulating substrate such as a glass substrate 21; a black matrix (BM) layer 22, and color layers (color filters) 23 which are formed by a photolithographic technique; and a counter electrode 24 which is formed by sputtering.

The TFT substrate 30 includes: a transparent insulating substrate such as a glass substrate 31; gate wires 32 (scan lines) formed by a photolithographic technique, and a gate shielding layer (not shown) for shielding the peripheral part of the pixels against light; a gate insulating film 33 deposited using a vacuum evaporation technique; drain electrodes 34 (signals lines) formed by a photolithographic technique and are connected to drains of respective column of TFTs; a passivation insulating film 35 formed by a vacuum evaporation technique; TFTs (not shown) configured by amorphous silicon or polysilicon; and a planarization film 36 configured by, for instance a photosensitive organic film. Spacer recesses are formed on the surface of the planarization film 36 by removing a surface portion of the photosensitive organic film 36.

Subsequently, in a step S102, each of the CF substrate 20 and the TFT substrate 30 is subjected to a series of treatments including, e.g., cleaning of the substrate, printing of an orientation film, calcination of the orientation film, rubbing treatment, cleaning of the substrate after the rubbing treatment drying of the substrate, and the final orientation treatment. Thereafter, one of the substrates (e.g., the CF substrate 20 in this case) is mounted and fixed onto the X-Y table 14 of the ink jet printing apparatus 100 shown in FIG. 1.

Thereafter, in a step S103, data showing the areas to locate therein spacers, the volume of ink droplet ejected by each ink jet nozzle (e.g., the number of spacer members to eject), and the width of the overlapping area 18 is input to the controller 15 depending on the product to manufacture.

Subsequently, in a step S104, image reading is carried out to read alignment marks on the substrate on the X-Y table 14. In next step S105, ink jet nozzles 12 from which the ink is to be ejected are selected in accordance with the material of the substrate.

Subsequently, in a step S106, the controller 15 drives the ink jet nozzles 12 to eject the ink mixed with spacer members while scanning or moving the ink jet head 13 in the first direction. Spacers are thereby provided in the first ejection area 16. At this stage, spacers are not provided in a portion of the overlapping area corresponding to the second row of spacers as counted from the rightmost row of spacers. The spacers in this second row are provided by an excursion of the leftmost ink jet nozzle of the ink jet head 13 during the next excursion of the ink jet head 13.

Subsequently, in step S107, the controller 15 determines whether or not provision of all the spacers has been completed. If not completed, the controller 15 moves the X-Y table 14 in the second direction in next step S108 so that a next excursion of the ink jet head 13 overlaps a portion of the precedent excursion. Operation of the steps S106 to 108 is repeated until the spacers are provided for all the image area of the LC panel.

After completion of the provision of spacers, in step S109, a heat treatment is carried out on the substrate on which spacers have been printed as described above, whereby the spacers are fixed onto the substrate.

Subsequently, assembly of the TFT substrate and CF substrate is performed in step S110. Specifically, a sealing material which has a light- and heat-cured property is provided onto one of the substrates. Further, LC is dropped on the other one of the substrates, and both of the substrates are stacked one on another. UV-curing and heat-curing of the sealing material are carried out to complete the LC panel. Thereafter, the LC panel and a backlight unit are assembled together to complete manufacture of the LCD device.

In the process as described above, the ink is ejected from the ink jet nozzles 12 onto the CF substrate 20, during the excursion of the ink jet head 13 including the ink jet nozzles 12 arranged in an array. At this stage, the control of the ink jet nozzles is performed so that an excursion of a predetermined number of ink jet nozzles 12 in the vicinity of the end of the array of the ink jet nozzles 12 overlaps the next excursion of the corresponding ink jet nozzles 12 without causing overlapping ejection of the ink within the overlapping area. In this manner, an abrupt change in the amount of ejected ink, i.e., the number of ejected spacer members is avoided for the adjacent rows of the spacers, whereby an uneven gap is suppressed. As a result deterioration of the image quality of the LCD device can be reduced.

Figure 8:
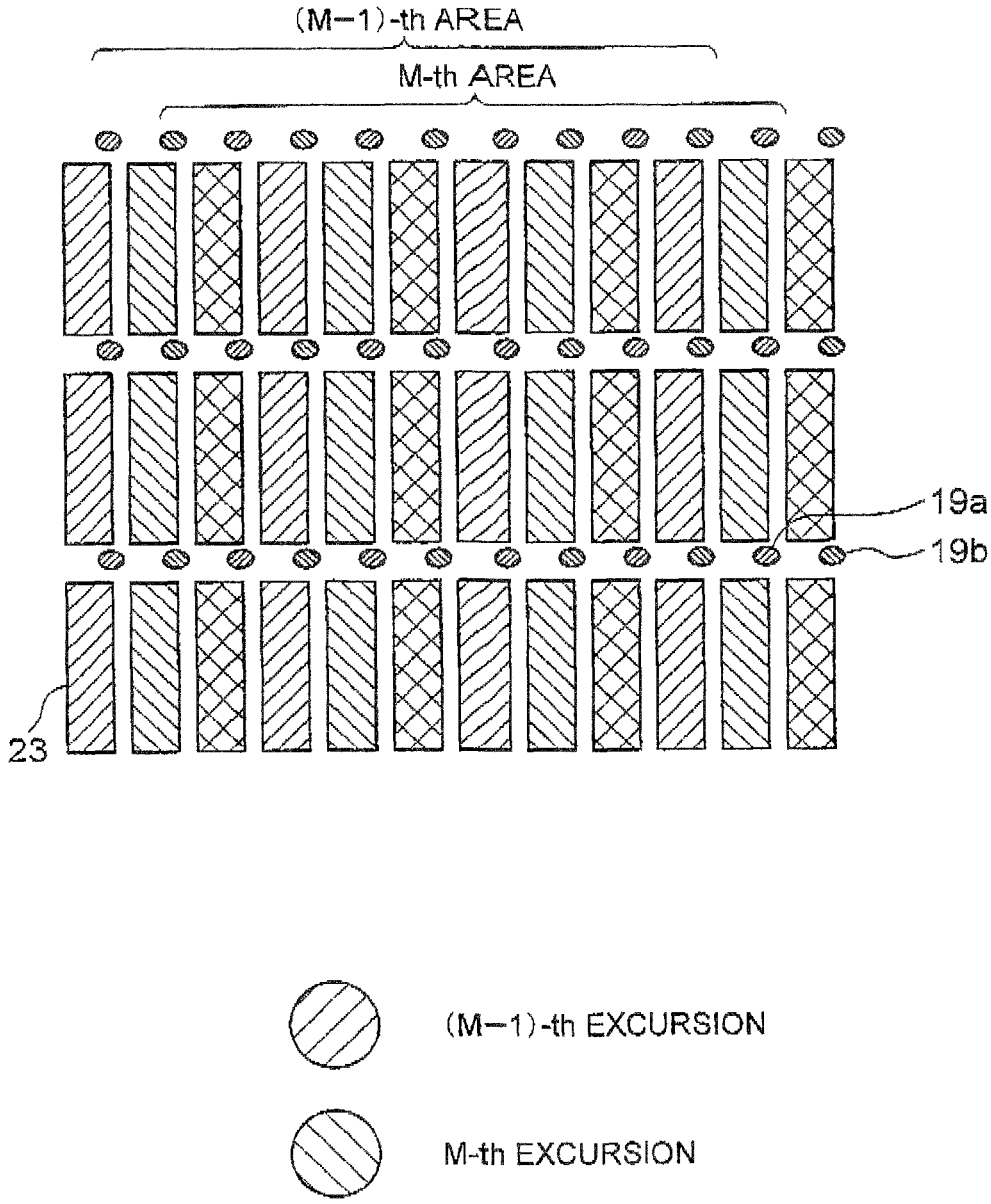
FIG. 8 is a top plan view showing an example of the layout of spacers on the CF substrate in a LCD device manufactured by an ink jet printing apparatus according to a second embodiment of the present invention.

Next a method and an apparatus for manufacturing a LCD device by using an ink jet printing process according to a second embodiment of the present invention will be described with reference to FIG. 8. FIG. 8 is a top plan view showing the layout of spacers on the CF substrate in the LCD device of the present embodiment.

In the first embodiment as described above, the number of overlapping rows is set to equal to or less than ½ of the number of ink jet nozzles 12. In the present embodiment every other one of the plurality of ink jet nozzles 12 is activated to operate for ejection, and the ink jet head 13 is shifted by one row along the second direction.

More specifically, spacers 19*a* are provided for every other row (e.g., 1st; 3rd, 5th, 7th, 9th, and 11th rows as counted from the left end of the figure) during a (M-1)-th excursion of the ink jet head. During the M-th excursion of the ink jet head, spacers 19*b* are provided for the other rows (i.e., 2nd, 4th, 6th, 8th, 10th, and 12th rows as counted from the left end of the figure), which have not yet been provided with spacers in the precedent excursion for the (M−1)-th excursion. Before the (M+1)-th excursion of the ink jet head 13, the ink jet head 13 is shifted so as not to overlap the ejection area of the M-th excursion of the ink jet head 13. This operation is repeated in a similar manner.

In the present embodiment, spacers are provided in such a manner that a large part of each excursion of the ink jet head 13 overlaps a next excursion of the ink jet head 13. Therefore, a uniform number of spacer members included in each spacer can be obtained while using an array of ink jet nozzles, wherein both the outermost ink jet nozzles generally have an unstable volume of the ejected ink droplet.

Each of the above embodiments describes the case of applying the ink jet printing apparatus 100 of the present invention to the manufacture of a LCD device. However, the present invention is not limited to the above embodiments, and may be applicable to manufacture of any arbitrary device in which the gap between a first substrate and a second substrate is defined by a number of spacers, e.g., an array of spacers.

The present invention can be used in a method for manufacturing a LCD device in which spacers are provided on one or both of a CF substrate and a TFT substrate, and can also be utilized in an ink jet printing apparatus which ejects an ink mixed with spacer members.

As described above, the advantage of the above embodiments is that deterioration of the image quality caused by an uneven gap between the substrates is reduced. This advantage is achieved on the following grounds. Spacers (spacer members) mixed in an ink is provided in a matrix on the substrate while an ink jet head having a plurality of ink jet nozzles arranged in a one-dimensional array is moved in a scanning operation. During excursion of the ink jet head with respect to the X-Y table, excursion of some of the ink jet nozzles overlap a subsequent excursion of the other ink jet nozzles without an overlapping ejection of the ink, whereby a abrupt variation in the amount of ink ejected from ink jet nozzles is reduced in the overlapping area. Accordingly, an uneven gap at the interface area between adjacent two section areas is reduced, and thus image degradation is hardly conceived by an observer.

Another advantage of the above embodiments is that a higher contrast ratio can be obtained in the LCD device. This advantage is achieved on the following grounds. By use of spherical spacer members having a high elasticity each spacer has a higher ability to allow a larger amount of change in the gap length caused by a temperature change. In addition, since the spacers are provided on the stripe of the black matrix on the CF substrate the spacers do not cause a leakage of light while reducing an uneven gap between the substrates.

While the invention has been particularly shown and described with reference to exemplary embodiment and modifications thereof the invention is not limited to these embodiment and modifications. It will be understood by those of ordinary skill in the art that various changes in form and details may be made therein without departing from the spirit and scope of the present invention as defined in the claims.

What is claimed is:

1. An apparatus for ejecting an ink, comprising: an ink jet head mounting thereon N ink jet nozzles (where N is an integer not smaller than 2) arranged in an array; an X-Y table for mounting thereon a substrate; and a controller, wherein the controller is configured to control the ink jet head and/or the X-Y table to:

cause a first excursion of the ink jet head with respect to the substrate along a first direction perpendicular to an extending direction of the array, said first excursion being accompanied by ink ejection from the ink jet nozzles to provide a first ejection area of the ink droplets on the substrate;

cause a second excursion of the ink-jet head, alternately with the first excursion, with respect to the substrate along the first direction, said second excursion being accompanied by ink ejection from the ink jet nozzles to provide a second ejection area of the ink droplets on the substrate;

cause a third excursion of the ink jet head, between the first excursion and the second excursion, with respect to the substrate in a direction parallel to the extending direction of the array, wherein:

the first ejection area and the second ejection area having therebetween an overlapping excursion of at least two of the ink jet nozzles, and at least one of the at least two of the ink jet nozzles does not eject the ink during either the first excursion or the second excursion, the at least one excluding an outermost one of the ink jet nozzles.

2. The apparatus according to claim 1, wherein: N is a integer not smaller than 4; and the second excursion is controlled so that second and (N−1)-th ink jet nozzles disposed in the overlapping area stop ejection of the ink droplets, the second and (N−1)-th being counted from an outermost ink jet nozzle in the array.

3. The apparatus according to claim 1, wherein: N is an even number not smaller 4; and the second excursion is controlled so that excursion of N−1 ink jet nozzles overlaps the excursion of some ink jet nozzles in the fit excursion and even-numbered ink jet nozzles stop ejection of the ink droplet, the odd-numbered ink jet nozzles being counted from the outermost ink jet nozzle.

4. The apparatus according to claim 1, wherein the substrate is a color filter substrate, and the ink is ejected onto a light shield area of the color filter substrate.

* * * * *